US006237541B1

(12) United States Patent
Alliston et al.

(10) Patent No.: US 6,237,541 B1
(45) Date of Patent: May 29, 2001

(54) PROCESS CHAMBER IN CONNECTION WITH A CIRCULATING FLUIDIZED BED REACTOR

(75) Inventors: Michael G. Alliston, Lewisburg, PA (US); Ari Kokko; Tero Luomaharju, both of Tampere (FI); Timo Mero, Nokia (FI)

(73) Assignee: Kvaerner Pulping Oy, Tampere (FI)

( * ) Notice: Subject to any disclaimer, the term of this patent is extended or adjusted under 35 U.S.C. 154(b) by 0 days.

(21) Appl. No.: 09/552,557

(22) Filed: Apr. 19, 2000

(51) Int. Cl.[7] ..... B09B 3/00
(52) U.S. Cl. ..... 122/4 D; 165/104.16
(58) Field of Search ..... 122/4 D, 6.5; 165/104.16; 432/58; 110/216, 245

(56) References Cited

U.S. PATENT DOCUMENTS

| | | | | |
|---|---|---|---|---|
| 5,060,599 | | 10/1991 | Chambert . | |
| 5,181,481 | * | 1/1993 | Dietz | 122/4 D |
| 5,332,553 | | 7/1994 | Hyppanen . | |
| 5,345,896 | | 9/1994 | Hyppanen . | |
| 5,463,968 | * | 11/1995 | Abdulally | 122/4 D |
| 5,526,775 | * | 6/1996 | Hyppanen | 122/4 D |
| 6,029,612 | * | 2/2000 | Wietzke et al. | 122/4 D |

FOREIGN PATENT DOCUMENTS

WO 89/05942 6/1989 (WO) .

* cited by examiner

*Primary Examiner*—Gregory Wilson
(74) *Attorney, Agent, or Firm*—Connolly Bove Lodge & Hutz

(57) ABSTRACT

A process chamber is placed in connection with a circulating fluidized bed reactor for utilizing internal or external circulation of solid material or both in heat transfer purposes. Said process chamber is located inside the furnace of the circulating fluidized bed reactor adjacent to at least one of the furnace walls. The interior of said process chamber is provided with heat exchanger means for heat transfer from the solid material to heat transfer medium inside the heat exchanger means. The process chamber comprises a top closed barrier wall forming the roof of the process chamber, wherein the inlet of the solid material into the process chamber is arranged to the lower part of the wall of the process chamber and the outlet of the solid material out of the process chamber is arranged to the upper part of the wall of the process chamber. Prior to the said process chamber in the direction of the flow of said solid material an inlet chamber is provided inside the furnace of the circulating fluidized bed reactor for directing the solid material to the inlet of the process chamber.

23 Claims, 7 Drawing Sheets

PROCESS CHAMBER IN CONNECTION WITH A CIRCULATING FLUIDIZED BED REACTOR

BACKGROUND OF THE INVENTION

The present invention relates to a process chamber in connection with a circulating fluidized bed reactor for utilizing internal or external circulation of solid material or both in heat transfer purposes. Said process chamber is located inside the furnace of the circulating fluidized bed reactor adjacent to at least one of the furnace walls, and the interior of said process chamber is provided with fluidized bed heat exchanger means for heat transfer from the solid material to heat transfer medium inside the heat exchanger means.

Fluidized bed heat exchangers (later on abbreviated as FBHE's), which transfer heat between bed of fluidized particulate solids and heat transfer medium, have been in use for many years and in many appliances.

A circulating fluidized bed reactor (later on abbreviated as CFB) comprises a furnace and at least one particle separator which are connected together. A particle separator separates solid particles from flue gas—solid particles suspension entering the separator from the upper part of the furnace. Separated solids are recycled back to the lower part of the furnace via separator and loopseal. This solid circulation is called external circulation, later on EC. In addition to vertical upflow of flue gas and solid particles in the furnace entering the separator inlet, there is a vertical downflow of particles near the furnace walls. This solids circulation is called internal circulation, later on IC.

FBHE's in circulating fluidized bed reactors can be either internal or external type or both, depending on whether the FBHE is utilizing the particles of internal and/or external circulation. A typical CFB process feature is that external circulation of solid material decreases rapidly when load decreases, with the result that heat transfer in the FBHE can become inadequate. Systems with FBHF's in contact with both internal and/or external particle flow streams have been developed to solve that problem.

In CFB reactors, FBHE process chambers can be integrated with the furnace walls and FBHE can be constructed by using bent tubes. The location of an integrated FBHE process chamber can be anywhere from the lower part to the upper part of the reactor furnace, and may be either inside or outside of the furnace walls.

FBHE process chambers located inside the lower part of the furnace can be open in the top part to allow internally refluxing particles to flow into the FBHE process chamber downwards along the furnace walls as suggested by Chambert according to U.S. Pat. No. 5,060,599. Further it is possible according to Chambert to arrange the site of the construction so that particles from the cyclone outlet loop seal can also spill into the same FBHE process chamber.

Furthermore, Hyppanen in accordance with U.S. Pat. No. 5,332,553 suggests a FBHE process chamber in which the roof of said FBHE process chamber is provided with holes or screens for classifying particles before they can enter the FBHE process chamber. However, this kind of roof construction with hole s or screens has the disadvantage that screens can be blocked (or eroded) by heavy solids flow, and especially by fuel and coarse particles splashing from the main fluidized bed because said FBHE process chamber is located inside the reactor furnace at the lower part of the same.

SUMMARY OF THE INVENTION

According to the present invention a FBHE process chamber in connection with a circulating fluidized bed reactor, i.e. CFB, is provided for utilizing internal or external circulation of solid material or both in heat transfer purposes, wherein said process chamber is located inside the furnace of the circulating fluidized bed reactor adjacent to at least one of the furnace walls, the interior of said process chamber being provided with heat exchanger means for heat transfer from the solid material to heat transfer medium inside the heat exchanger means, wherein the process chamber comprises a top closed barrier wall forming the roof of the process chamber, and wherein the inlet of the solid material into the process chamber is arranged to the lower part of the wall of the process chamber and the outlet of the solid material out of the process chamber is arranged to the upper part of the wall of the process chamber.

The main object of the present invention is that by using totally particle tight barrier wall forming the roof of the process chamber above the FBHE, the following improvements with respect to relevant prior art presented hereabove can be achieved:

There are no such open areas above the FBHE which are:

liable to plugging, liable to erosion, complicated to manufacture, and falling particles cannot impact FBHE tubes, so that there is no need of any additional shields for the FBHE tubes inside the process chamber.

Further according to a very important feature of the invention prior to the said process chamber in the direction of the flow of said solid material an inlet chamber is provided inside the furnace of the circulating fluidized bed reactor for directing the solid material to the inlet of the process chamber.

With reference to the foregoing it is further the object of the present invention to overcorhe the drawbacks of the prior art constructions by the above mentioned combined system of at least one process and inlet chambers. Said combination provides sophisticated possibilities to control over the overall heat transfer rate in a FBHE process chamber. In accordance with the above mentioned advanced system the heat transfer of a FBHE process chamber can be controlled by various manners such as:

1. by guiding a variable portion of the circulating solid material to pass the FBHE process chamber, or
2. differential fluidization within the FBHE process chamber and the inlet chamber (for instance possibility to vary fluidizing velocity in the inlet chamber without fear of erosion),
3. sectioning the FBHE i.e. the total area of heat transfer surfaces into separately controllable process chambers, or/and
4. by combinations of at least two of the manners 1–3

Further according to the present invention said inlet chamber is arranged in vertical direction inside the furnace of the circulating fluidized bed reactor for directing the solid material to the inlet of the process chamber, wherein the inlet of the inlet chamber located at the top of the same is open for receiving flow of solid material and wherein the top closed barrier wall of the process chamber is inclined so as to guide the solid material flowing down onto the top closed barrier wall to the inlet of the inlet chamber.

Thus, additionally the combined system of at least one process and inlet chambers provides following advantages:

the internal circulation of solid material tend to trap into the inlet chamber because of slope or inclined closed barrier wall forming the roof of the process chamber occasionally possible unintended stalling of the flow of solid material through the FHBE does not interfere the total CFB process i.e. the internal or external circulation of solid material can be maintained. The excess of the flow of solid material passes by the inlet of the inlet chamber into the reactor furnace.

BRIEF DESCRIPTION OF THE DRAWINGS

An embodiment of the present invention is now described in detail with reference to the enclosed drawings in which.

DETAILED DESCRIPTION OF A PREFERRED EMBODIMENT OF THE INVENTION

Figure 1:
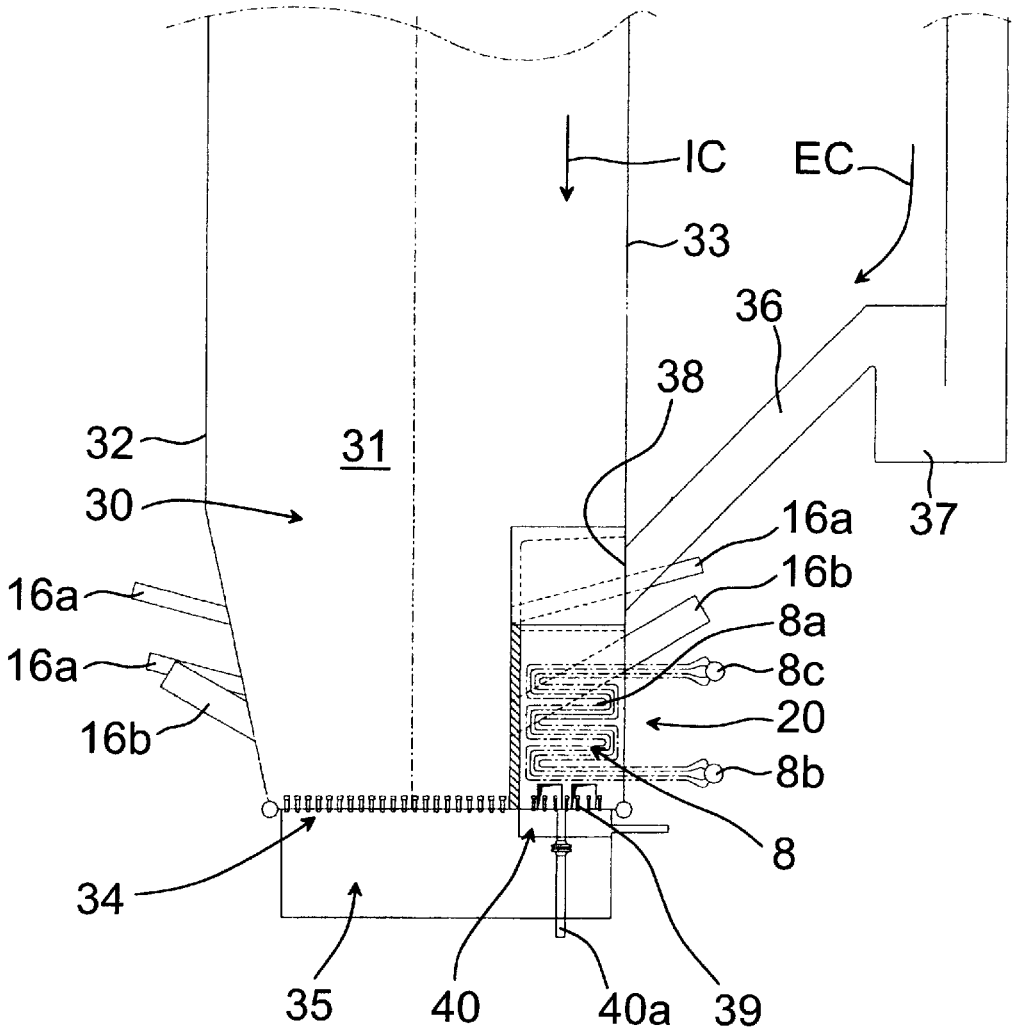
FIG. 1 shows in a partial vertical sectional view a first embodiment of a process chamber according to the invention in connection with a circulating fluidized bed reactor which is shown schematically, said view taken along the plane of the side walls of said reactor.

With reference especially to FIG. 1 a circulating fluidized bed reactor with two sets of chambers 46 (four process chambers 20 and two inlet chambers 7 divided into two sets of chambers 46, i.e. two process chambers and one inlet chamber in each of the two sets of chambers) of the invention comprises a reactor furnace 30, which is limited by side, front and rear walls 31, 32 and 33 respectively in the vertical direction. The bottom section of the reactor furnace 30 is equipped with a grid construction 34 for introducing fluidizing air into the reactor furnace 30. Further, a windbox system 35 for feeding fluidizing air is placed below the grid construction 34.

At the upper part of the reactor furnace 30 (not shown in FIG. 1) a connection to the particle separator system 48 (two separators 49, 50 shown in FIG. 2) is arranged. For recycling the particles a conventional return duct 36 with a conventional loop seal 37 is arranged in connection with the particle separator. The return duct 36 is connected to the wall in question, i.e. the rear wall 33 of the reactor furnace 30, thereby providing an outlet 38 of solid material of the external circulation EC into the reactor furnace 30.

The process chamber 20 is located inside the reactor furnace 30 adjacent to the furnace walls, preferably as shown in FIGS. 2, 3, 5, and 6 adjacent to the rear wall 33 of the reactor furnace 30. The top closed barrier walls (i.e. the roof 21 of each of the process chambers 20) are totally closed. Further, it is advantageous that the roof 21 can be inclined to force or guide the internal circulation IC of solid material to flow into the inlet chamber 7, which is directed in the vertical direction beside the process chamber 20. The process chamber 20 includes heat exchanger(s) 8 i.e. FBHE.

The material inside the process chamber 20 can be fluidized with nozzle system 39 arranged at the bottom of the process chamber 20. A windbox 40 is arranged below the bottom of the process chamber 20 for feeding of fluidizing air through the nozzle system 39. The windbox 40 is divided into several separate sections or segments 14 by separation walls 41 inside the windbox 40 in order to accomplish controllable feed of fluidizing air. Furthermore, each process chamber 20 is provided with drain tubes 40*a*.

The particles i.e. the flow of solid material enter from the inlet chamber 7 into the process chamber 20 through the inlet 9 which is arranged to the lower part of the side wall 42 of the process chamber 20 below the lowest level of heat exchanger(s) 8 i.e. FBHE. The particles i.e. the flow of solid material exit the process chamber 20 into the reactor furnace 30 through the outlet 15 which is arranged to the upper part of the front wall 43 of the process chamber 20 due to the expansion of the bed of particles of solid material by the feed of fluidizing air. The outlet 15, through which the particles from the process chamber 20 flow into the reactor furnace 30 is located at the front wall 43 above the highest level of heat exchanger(s) 8 i.e. FBHE. Thus the flow of solid material through the process chamber 20 in the vertical direction upwards is in heat transfer contact with the heat exchanger (s) 8 i.e. FBHE along the whole vertical range of the same. The heat exchanger(s) 8 comprise(s) a set of tubes 8*a* (FIG. 1) which are led through the rear wall 33 of the reactor furnace 30 both at the inlet and outlet ends of the same. For arranging the heat transfer medium flow through the tubes 8*a* the headers 8*b*, 8*c* are provided both at the inlet and outlet ends of the tubes 8*a*.

Both the inlet 9 of the solid material and the outlet 15 of the solid material can comprise one or several separate openings or screens.

The inlet 22 of the inlet chamber 7 is substantially or totally open in the horizontal direction to allow the particles freely to enter the inlet chamber 7. Thereafter, the particles fall downwards towards the bottom of the inlet chamber 7. The particulate solid material inside the inlet chamber 7 can be fluidized with nozzle system 10 arranged at the bottom of the inlet chamber 7. A windbox 44 is arranged below the bottom of the inlet chamber 7 for feed of fluidizing air through the nozzle system 10. The windbox 44 is divided into several separate sections 13 by separation walls 45 inside the windbox 44 in order to accomplish controllable feed of fluidizing air. Furthermore, each inlet chamber 7 is provided with drain tubes 44*a*.

Figure 2:
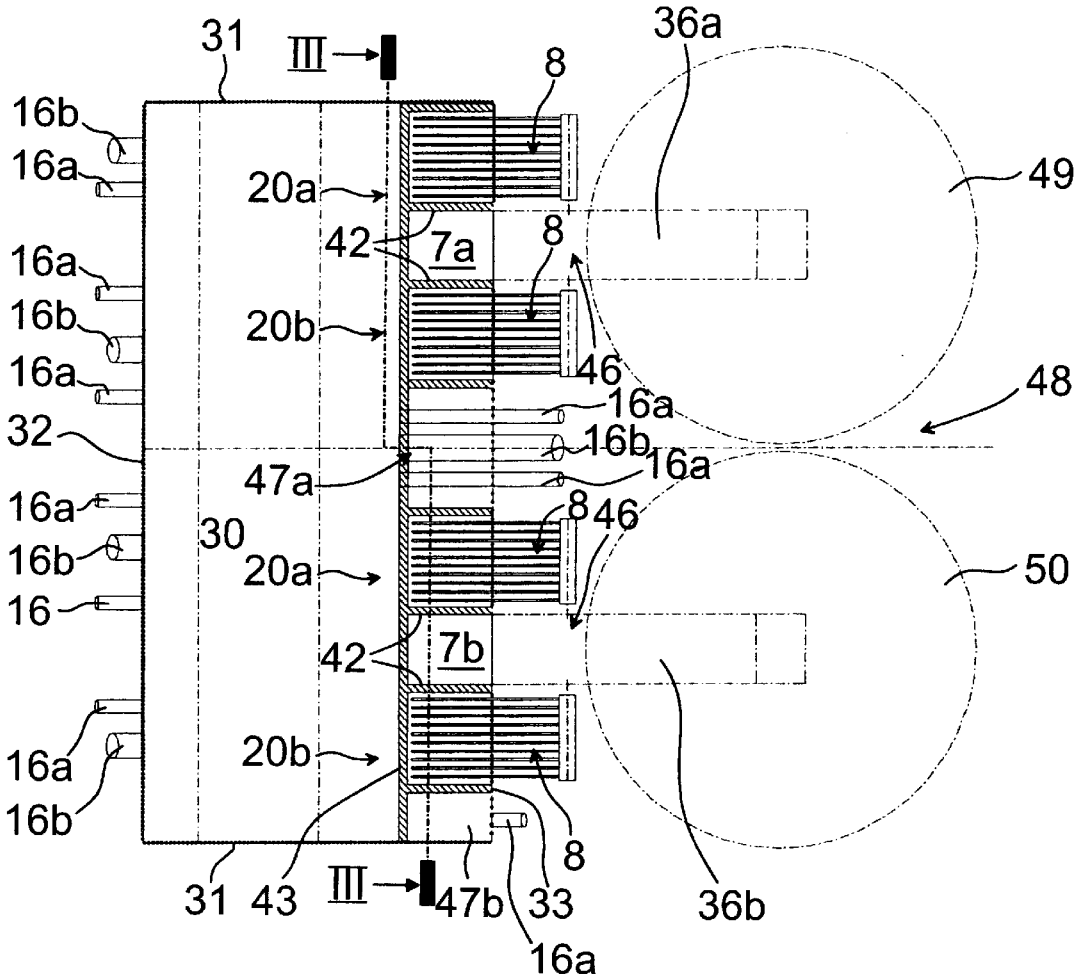
FIG. 2 shows in a horizontal sectional view a first embodiment of a set of chambers according to the invention in connection with a circulating fluidized bed reactor which is shown schematically.
Figure 3:
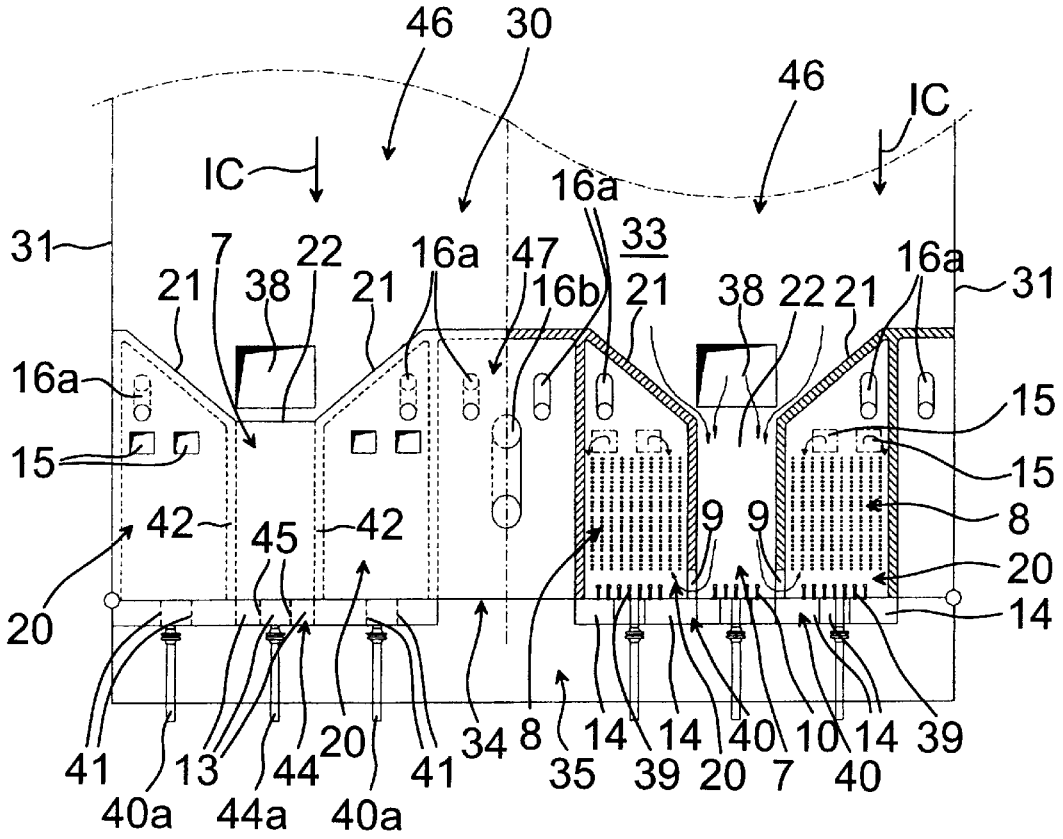
FIG. 3 shows in a vertical sectional view the first embodiment of a set of chambers of FIG. 2 according to the invention in connection with a circulating fluidized bed reactor, said view taken along the line III—III of FIG. 2 (along the plane of the front and rear walls of said reactor)

The inlet chamber 7 shares a common substantially vertical wall with at least one adjacent process chamber 20 i.e. the side wall 42 according to the embodiment of FIGS. 1–3. Each common wall between the inlet chamber 7 and the process chamber 20 has an outlet of the inlet chamber 7, which simultaneously serves as the inlet 9 of the solid material into the process chamber 20 which permits particles to pass from the inlet chamber 7 into the process chamber 20.

The outlet 38 of solid material of the external circulation EC into the reactor furnace 30 is provided at or above the inlet 22 of the inlet chamber 7.

As especially shown in FIG. 2, the process chambers 20 together with inlet chambers 7 are arranged inside the reactor furnace 30 to comprise two sets of chambers 46, which are placed side by side at the bottom of the reactor furnace 30 adjacent to the rear wall 33 of the reactor furnace 30. Both sets of chambers 46 are provided in a manner that an inlet chamber 7*a*, 7*b* is provided in the middle section of the set of chambers 46 and a process chamber 20*a*, 20*b* is provided on both sides of the said inlet chamber 7*a*, 7*b*. Inlets 9 to the process chambers 20*a*, 20*b* are provided at the lower parts of division walls (i. e. side walls 42) between said two process chambers 20*a*, 20*b* and said inlet chamber 7*a*, 7*b*, said division walls being arranged substantially in the perpendicular direction with regard to the adjacent rear wall 33 of the reactor furnace 30.

Further, said two sets of chambers 46 have a common front wall 43 arranged substantially in parallel direction with regard to the adjacent rear wall of the reactor furnace 30. The outlets 15 of both of the process chambers 20 in the both sets of the chambers 46 are arranged to the upper part of the front wall 43.

The top closed barrier walls i.e. the roofs 21 of both of the process chambers 20*a*, 20*b* (FIG. 2) are inclined in a manner that they are slanting towards the inlet 22 of the inlet chamber 7*a*, 7*b* so as to force or to guide the internal circulation IC of solid material to flow into the inlet chamber 7*a*, 7*b*. The outlet 38 of the external circulation EC of the solid material is arranged to lie at the adjacent rear wall 33 of the reactor furnace 30 at or right above the inlet 22 of the inlet chamber 7*a*, 7*b* so as to guide the external circulation EC of solid material to flow into the inlet chamber 7 directly from the return duct 36*a*, 36*b*. As shown in FIG. 2, the particle separator system 48 is divided into two separators 49, 50 which both feed their own set of chambers 46 through the respective return ducts 36*a*, 36*b*.

The rear wall of each of the process chambers 20 and the inlet chambers 7 is the adjacent rear wall 33 of the reactor furnace 30 of the fluidized bed reactor. Thus with reference to the foregoing as a whole, the horizontal cross section of the process 20 and inlet chambers 7 is rectangular.

Both the inlet chamber 7 and the process chamber 20 can be drained separately. The elevation of the bottom grids of both chambers 7, 20, i.e. the location of the nozzle systems 10 and 39, is at the selected level which may be the same level as the level of the grid construction 34 of the furnace reactor 30 or above the same depending on the needs of the overall construction.

It should be noted that an efficient control of the total FBHE process can be carried out by using separate fluidization velocities in the process chamber(s) 20 and varying the flow of solid material from the inlet chamber 7 into the process chamber(s) 20. The flow of solid material from the inlet chamber 7 into the process chamber(s) 20 is controlled by the following method:

- when the inlet chamber 7 is not fluidized, the flow of solid material to the process chamber(s) 20 is stopped,
- when using high fluidizing velocity in the inlet chamber 7 the flow of solid material to the process chamber(s) 20 can be limited, and
- the highest amount of the flow of solid material to the process chamber(s) 20 can be achieved somewhere between the extreme cases hereabove.

Furthermore by segmented or sectioned fluidization (sectional wind boxes 44) of the inlet chamber 7, the selection between the amounts (dividends) of internal circulation IC and external circulation EC i.e. the flow of solid material into the inlet chamber 7 is possible.

As shown by reference numerals 16*a* (tubes) secondary air can be fed out of the common front wall 43 of both of the sets of chambers 46 through the process chamber(s) 20 or through the gap 47*a* located between the two adjacent sets of the chambers 46 at the middle section of the rear wall 33. Secondary air can also be fed into the furnace through a gap 47*b* provided between the side wall 31 and the ultimate wall of the sets of chambers. Further, secondary air can be introduced through the front wall 32 of the furnace reactor 30 and/or through the side walls 31 of the furnace reactor 30 (not shown).

As shown by reference numerals 16 b(tubes), the fuel is fed into the furnace substantially from the same locations as the secondary air.

Figure 4:
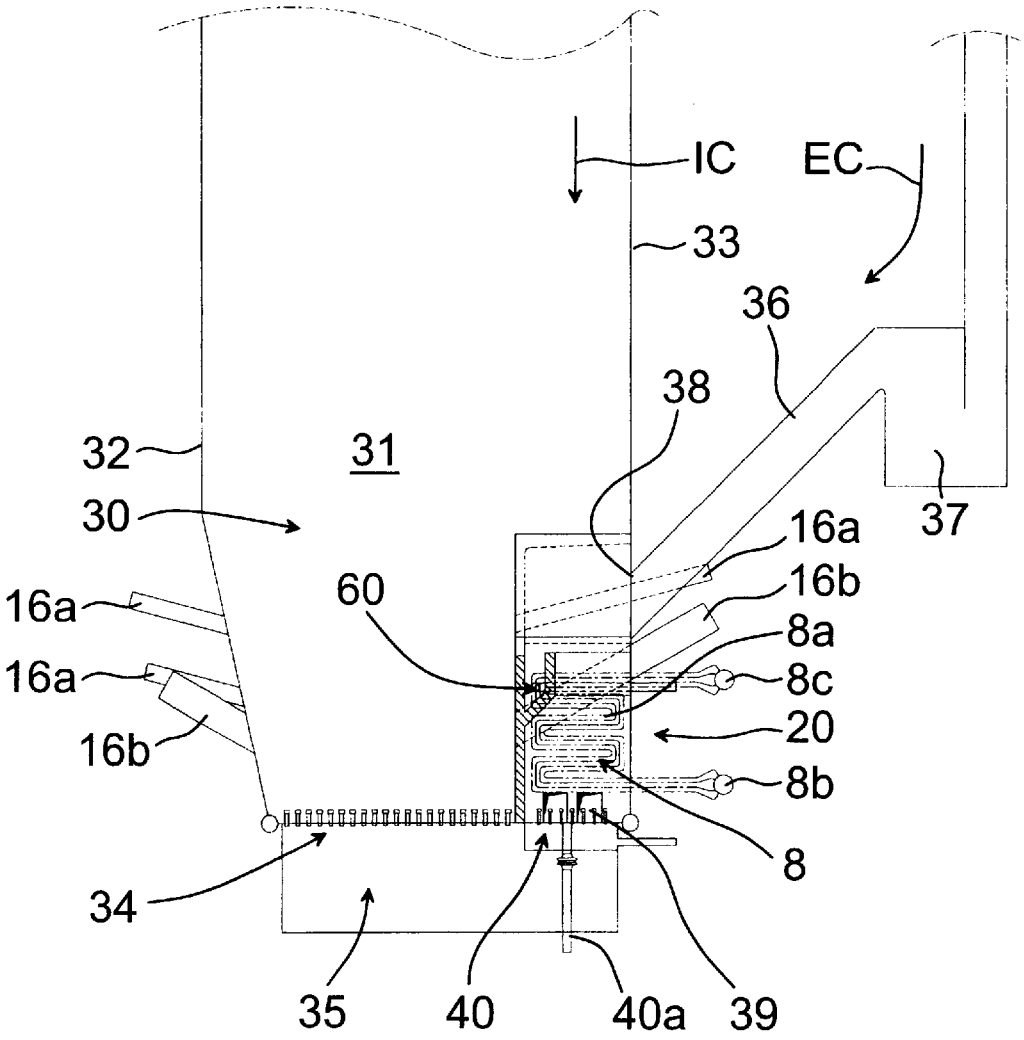
FIG. 4 shows in a partial vertical sectional view a first, modified embodiment of an inlet chamber according to the invention in connection with a circulating fluidized bed reactor which is shown schematically, said view taken along the plane of the side walls of said reactor.
Figure 5:
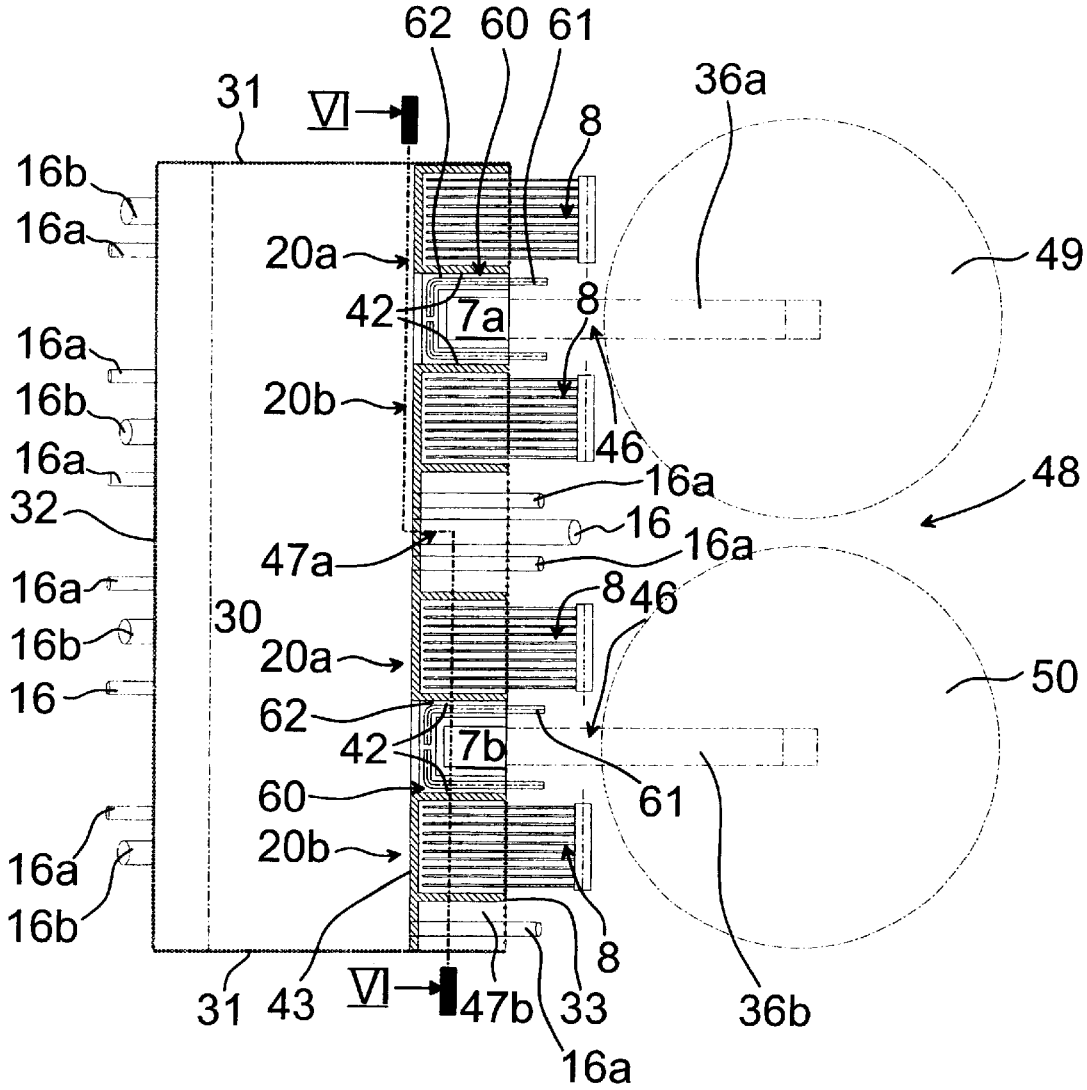
FIG. 5 shows in a horizontal sectional view a first, modified embodiment of a set of chambers according to the invention in connection with a circulating fluidized bed reactor which is shown schematically.
Figure 6:
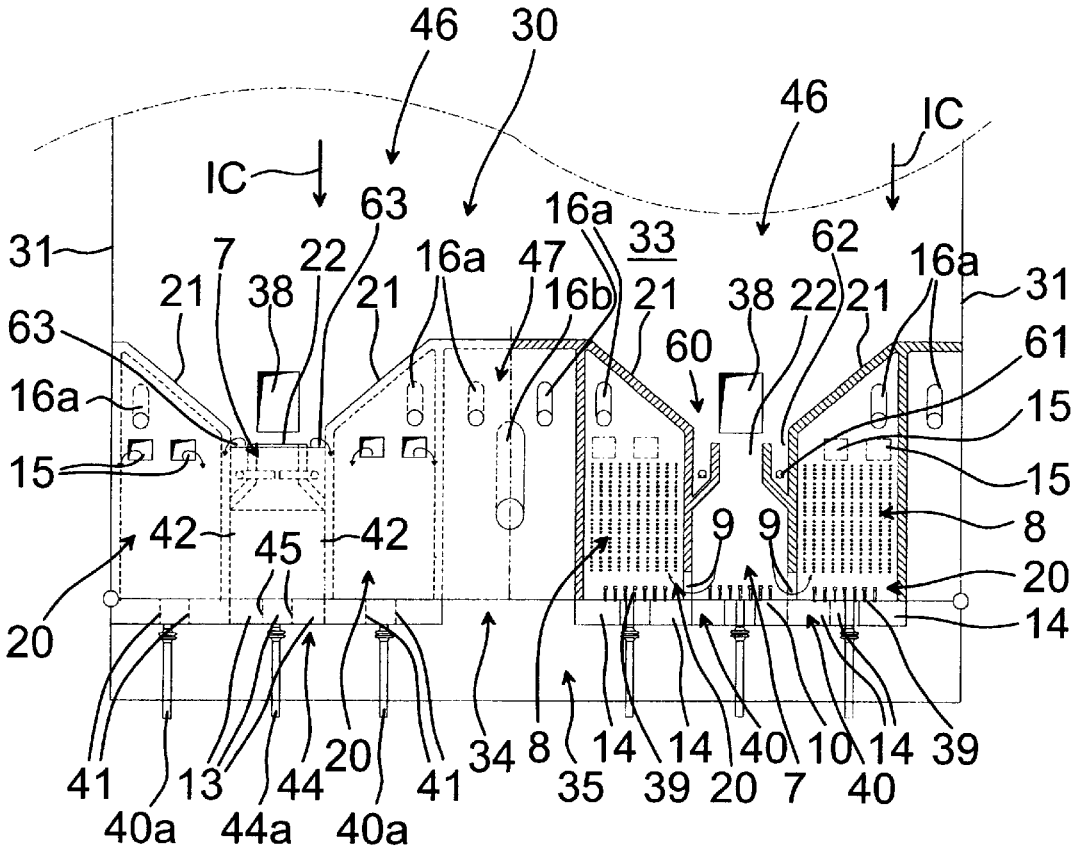
FIG 6 shows in a vertical sectional view the first, modified embodiment of a set of chambers of FIG. 5 according to the invention in connection with a circulating fluidized bed reactor, said view taken along the line VI—VI of FIG. 5 (along the plane of the front and rear walls of said reactor)

The embodiment in accordance with FIGS. 1–3 can be modified by means of a control system explained herebelow and shown in detail in connection with FIGS. 4–6. For the control purposes of the quantity of solid material of internal circulation IC entering the inlet chamber 7*a*, 7*b*, the inlet 22 of the inlet chamber 7*a*, 7*b* is provided with a segmented area 60 having its own fluidizing air supply 61. The segmented area 60 has a substantially U-shaped form in a horizontal section. The U-shaped tube system forming the air supply 61 is placed inside a U-shaped groove 62 at the inlet of the inlet chamber 7*a*, 7*b*, said tube system together with the groove reaching adjacent to both side walls 42 and adjacent to the front wall 43. The U-shaped groove 62 opens upwards and the direction of fluidizing air is selected in a manner, that when the segmented area 60 is fluidized, the solid material coming down the inclined roof 21 towards the inlet 22 of the inlet chamber 7*a*, 7*b* from internal circulation IC is forced to enter the furnace 30 via openings 63 at the upper part of the front wall 43. When this segmented area 60 is not fluidized, the solid material from the internal circulation IC flows over this segmented area 60 into the inlet chamber 7*a*, 7*b*.

The first embodiment of the invention is constructed in a manner that one centrally arranged inlet chamber feeds both circulations in a controlled manner to two adjacent process chambers.

Figure 7:
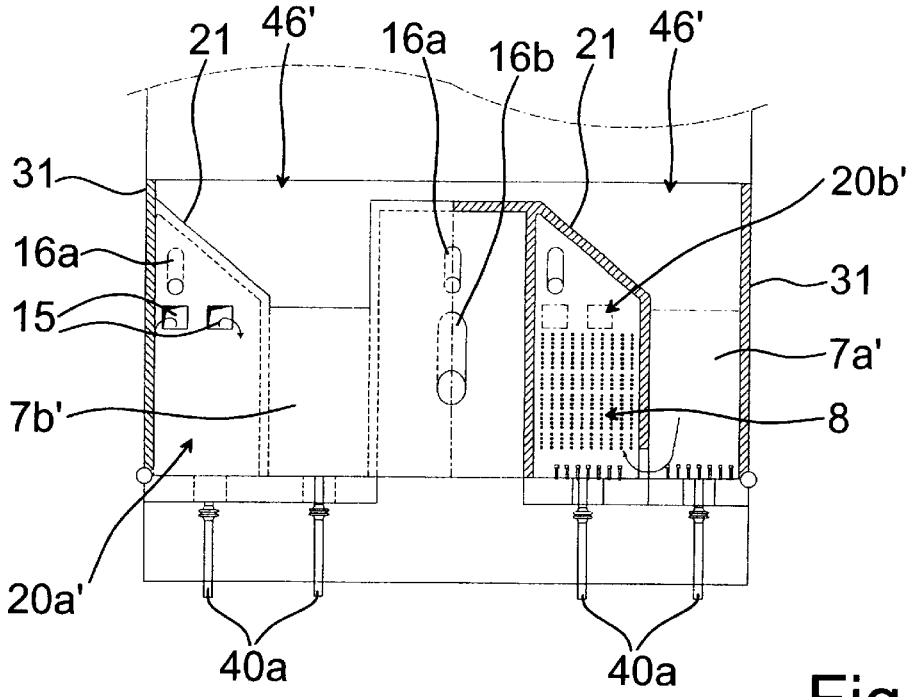
FIG. 7 shows in a similar vertical sectional view a second embodiment of a set of chambers as shown in connection with FIGS. 3 and 6.

With reference to FIG. 7 showing the second embodiment of the invention with two adjacent sets of chambers 46' located at the rear wall of the furnace as explained in greater detail in connection with the former embodiments as to the common features shown with similar reference numerals in FIG. 7, the process chamber of the invention can be used only in connection with internal circulation IC excluding the use of external circulation EC, which may be utilized by other means. Each set of chambers 46' comprises one inlet chamber 7*a*', 7*b*' and one adjacent process chamber 20*a*', 20*b*'. For the purposes described hereabove the inclination of the roof 21 is directed towards the inlet chambers 7*a*', 7*b*' of both of the sets of chambers 46'.

As shown in FIG. 7 the second embodiment of FIG. 7 is constructed in a manner that one inlet chamber feeds only one adjacent process chamber with the solid material from the internal circulation.

Figure 8:
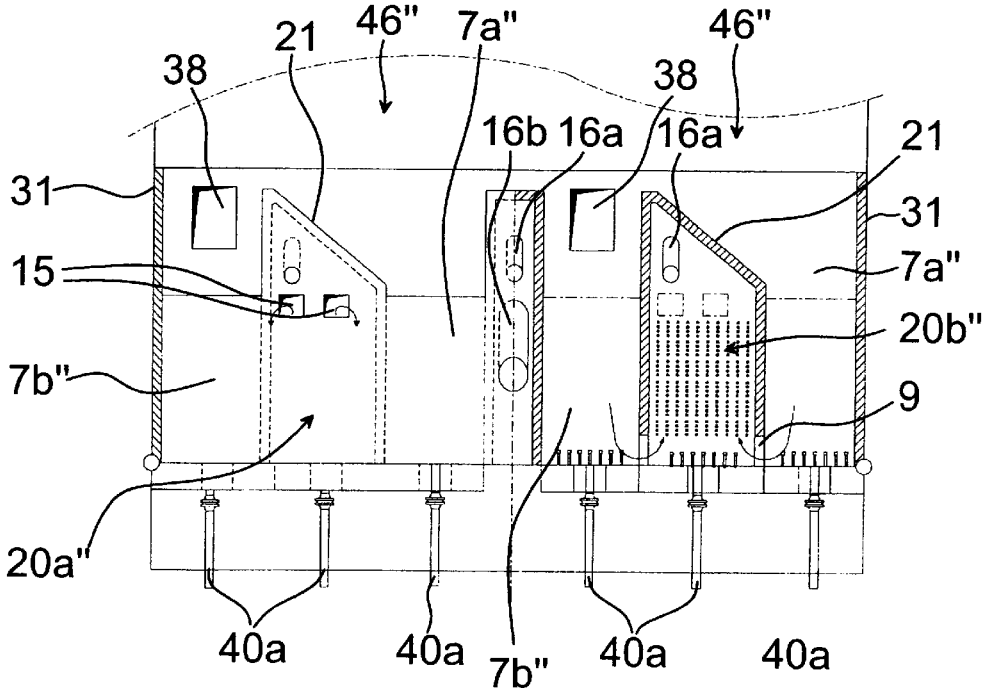
FIG 8 shows in a similar vertical sectional view a third embodiment of a set of chambers as shown in connection with FIGS. 3 and 6.

Furthermore, with reference to FIG. 8 showing the third embodiment of the invention with two adjacent sets of chambers 46" located at the rear wall of the furnace as explained in greater detail in connection with the former embodiments as to the common features shown with similar reference numerals in FIG. 8, a detailed selection between the use of internal circulation IC and external circulation EC is beneficial in some cases, for instance when fuels containing harmful components, such as chlorine and alkalis, are burned. The selection, if needed, can be carried out by, for instance, by locating two inlet chambers 7*a*", 7*b*" on both sides of a central process chamber 20*a*",20*b*", the first inlet chamber 7*a*" in the set of chambers 46" taking in solids only from internal circulation IC (ie. the inclination of the roof 21 is directed towards the first inlet chamber 7*a*" of both of the sets of chambers as shown) and the second inlet chamber 7*b*" in the set of chambers 46" taking mainly solids from external circulation EC (the outlet 38 of the solid material is right above the inlet of the second inlet chamber 7*b*" as shown). During the selection only the selected inlet chamber 7*a*", 7*b*" is fluidized and the other is not.

So, the third embodiment of the invention is constructed in a manner that two inlet chambers feed different circulations to a common process chamber.

What is claimed is:

1. A process chamber in connection with a circulating fluidized bed reactor for utilizing internal or external circulation of solid material or both in heat transfer purposes, wherein said process chamber is located inside the furnace of the circulating fluidized bed reactor adjacent to at least one of the furnace walls, the interior of said process chamber being provided with heat exchanger means for heat transfer from the solid material to heat transfer medium inside the heat exchanger means, wherein the process chamber comprises a top closed barrier wall forming the roof of the process chamber, and wherein the inlet of the solid material into the process chamber is arranged to the lower part of the wall of the process chamber and the outlet of the solid material out of the process chamber is arranged to the upper part of the wall of the process chamber.

2. The process chamber of claim 1, wherein the heat exchanger means are provided in vertical direction between the inlet and the outlet of the process chamber.

3. The process chamber of claim 1, wherein the rear wall of the process chamber is the said adjacent wall of the furnace of the fluidized bed reactor.

4. The process chamber of claim 1, wherein the process chamber is provided with a grid including means for fluidizing the interior of the process chamber by means of a fluidizing medium fed from a windbox below the grid.

5. A process chamber in connection with a circulating fluidized bed reactor for utilizing internal or external circulation of solid material or both in heat transfer purposes, wherein said process chamber is located inside the furnace of the circulating fluidized bed reactor adjacent to at least one of the furnace walls, the interior of said process chamber being provided with heat exchanger means for heat transfer from the solid material to heat transfer medium inside the heat exchanger means, wherein the process chamber comprises a top closed barrier wall forming the roof of the process chamber, wherein the inlet of the solid material into the process chamber is arranged to the lower part of the wall of the process chamber and the outlet of the solid material out of the process chamber is arranged to the upper part of the wall of the process chamber and wherein prior to the said process chamber in the direction of the flow of said solid material at least one inlet chamber is provided inside the furnace of the circulating fluidized bed reactor for directing the solid material to the inlet of the process chamber.

6. The process chamber of claim 5, wherein said at least one inlet chamber is arranged in vertical direction inside the furnace of the circulating fluidized bed reactor for directing the solid material to the inlet of the process chamber, and wherein the inlet of the inlet chamber located at the top of the same is open for receiving flow of solid material.

7. The process chamber of claim 5, wherein the top closed barrier wall is inclined so as to guide the solid material flowing down onto the top closed barrier wall to the inlet of the inlet chamber.

8. The process chamber of claim 5, wherein the outlet of the external circulation of the solid material is provided at or above the inlet of the inlet chamber.

9. The process chamber of claim 5, wherein the process chamber and the inlet chamber are arranged next to each other.

10. The process chamber of claim 5, wherein adjacent to the same wall of the furnace at least one set of chambers is provided in a manner that an inlet chamber and a process chamber are provided side by side to form the set of chambers.

11. The process chamber of claim 10, wherein two sets of chambers are provided side by side adjacent to the rear wall of the reactor furnace, wherein the particle separator system in connection with the external circulation of solid material is divided to feed the flow of solid material to both sets of chambers.

12. The process chamber of claim 5, wherein adjacent to the same wall of the furnace at least one set of chambers is provided in a manner that a process chamber is provided on both sides of an inlet chamber, said inlet chamber being arranged to deliver solid material to both process chambers.

13. The process chamber of claim 5, wherein adjacent to the same wall of the furnace at least one set of chambers is provided in a manner that a process chamber is provided in the middle section of the set of chambers, and an inlet chamber is provided on both sides of the process chamber to deliver solid material to said process chamber.

14. The process chamber of claim 5, wherein adjacent to the same wall of the furnace at least one set of chambers is provided in a manner that a process chamber is provided in the middle section of the set of chambers, and an inlet chamber is provided on both sides of the process chamber, wherein the first inlet chamber is connected to the internal circulation of the solid material, and wherein the second inlet chamber is connected to the external circulation.

15. The process chamber of claim 5, wherein adjacent to the same wall of the furnace at least one set of chambers is provided in a manner that an inlet chamber is provided in the middle section of the set of chambers, a process chamber is provided on both sides of the inlet chamber, inlets to the process chambers are provided at the lower parts of division walls between said two process chambers and said inlet chamber, said division walls being arranged substantially in the perpendicular direction with regard to the adjacent wall of the furnace, said set of chambers having a common front wall arranged substantially in parallel direction with regard to the adjacent wall of the furnace, and outlets of both of the process chambers in the set of the chambers are arranged to the upper part of the front wall.

16. The process chamber of claim 5, wherein adjacent to the same wall of the furnace at least one set of chambers is provided in a manner that an inlet chamber is provided in the middle section of the set of chambers, a process chamber is provided on both sides of the inlet chamber, inlets to the process chambers are provided at the lower parts of division walls between said two process chambers and said inlet chamber, said division walls being arranged substantially in the perpendicular direction with regard to the adjacent wall of the furnace, said set of chambers having a common front wall arranged substantially in parallel direction with regard to the adjacent wall of the furnace, outlets of both of the process chambers in the set of the chambers are arranged to the upper part of the front wall, and top closed barrier walls of both of the process chambers are inclined in a manner that they are slanting towards the inlet of the inlet chamber.

17. The process chamber of claim 16, wherein the windbox is divided into separate sections, each section having its own means for fluidizing medium feed.

18. The process chamber of claim 5, wherein adjacent to the same wall of the furnace at least one set of chambers is provided in a manner that an inlet chamber is provided in the middle section of the set of chambers a process chamber is provided on both sides of the inlet chamber inlets to the process chambers are provided at the lower parts of division walls between said two process chambers and said inlet chamber, said division walls being arranged substantially in the perpendicular direction with regard to the adjacent wall of the furnace, said set of chambers having a common front wall arranged substantially in parallel direction with regard to the adjacent wall of the furnace, outlets of both of the process chambers in the set of the chambers are arranged to the upper part of the front wall, and an outlet of the external circulation of the solid material is arranged to the adjacent wall of the furnace at the inlet of the inlet chamber.

19. The process chamber of claim 18, wherein the windbox is divided into separate sections, each section having its own means for fluidizing medium feed.

20. The process chamber of claim 5, wherein the inlet chamber is provided with a grid including means for fluidizing the interior of the inlet chamber by means of a fluidizing medium fed from a windbox below the grid.

21. The process chamber of claim 5, wherein the inlet of at least one inlet chamber is provided with means for controlling the flow of the solid material into the inlet chamber.

22. The process chamber of claim 5, wherein the inlet of at least one inlet chamber is provided with means for controlling the flow of the solid material into the inlet chamber in a manner that the inlet of the inlet chamber is provided with a segmented area having its own fluidizing air supply means.

23. The process chamber of claim 5, wherein the inlet of at least one inlet chamber is provided with means for controlling the flow of the solid material into the inlet chamber in a manner that the inlet of the inlet chamber is provided with a segmented area having its own fluidizing air supply means, said fluidizing air supply means having a substantially U-shaped form in a horizontal section and comprising a U-shaped tube system forming the air supply placed inside a U-shaped groove at the inlet of the inlet chamber, said tube system together with the groove reaching adjacent to both side walls and adjacent to the front wall of the inlet chamber, wherein the groove opens upwards and the direction of fluidizing air is selected in a manner, that when the segmented area is fluidized, the solid material from internal circulation IC coming down the top closed barrier wall of the process chamber towards the inlet of the inlet chamber is forced to enter the furnace.

* * * * *